US006491975B1

(12) United States Patent
Burns et al.

(10) Patent No.: US 6,491,975 B1
(45) Date of Patent: Dec. 10, 2002

(54) PROCESS FOR MAKING A BONDED SEWING THREAD WITH AQUEOUS BASED BONDING AGENTS VIA FOAM DELIVERY SYSTEM

(75) Inventors: Timothy L. Burns, Tega Cay, SC (US); Douglas E. Hirt, Seneca, SC (US); Joseph A. Roderiguez, Kings Mountain, NC (US)

(73) Assignee: Arteva North America S.A.R.L., Zurich (CH)

( * ) Notice: Subject to any disclaimer, the term of this patent is extended or adjusted under 35 U.S.C. 154(b) by 0 days.

(21) Appl. No.: 08/543,952

(22) Filed: Oct. 17, 1995

(51) Int. Cl.[7] ..... B05D 5/10

(52) U.S. Cl. ..... 427/208.2; 57/903; 427/373; 521/65

(58) Field of Search ..... 57/903; 521/65; 427/208.2, 373

(56) References Cited

U.S. PATENT DOCUMENTS 2,533,167 A 12/1950 Kilham
2,959,910 A * 11/1960 Woodson ..... 57/903
2,993,813 A * 7/1961 Tischbein ..... 427/373
3,111,440 A * 11/1963 Prentice ..... 156/71
4,141,315 A 2/1979 Nassenstein et al.
4,230,746 A * 10/1980 Nahta ..... 521/65
4,847,116 A 7/1989 Duit
5,230,922 A 7/1993 Fleissner

FOREIGN PATENT DOCUMENTS

DE 4327783 A1 8/1993

OTHER PUBLICATIONS

"Coating Carbon Fibers with Thermoplastic Polymers Using Aqueous Foam," R.R. Chary and D.E. Hirt, Clemson University, published in ANTEC '92, pp. 1181–1183.

* cited by examiner

*Primary Examiner*—John J. Gallagher
(74) *Attorney, Agent, or Firm*—Gregory N. Clements

(57) ABSTRACT

A process for bonding filament with aqueous based polyethylene terephthalate or polyurethane bonding agents via a foam delivery system is disclosed. The process includes the steps of: (a) providing a filament; (b) providing a foam prepared by foaming a solution comprising an agent selected from the group consisting of polyethylene terephthalate or polyurethane bonding agents; (c) applying a foam to said filament; and (d) drying and curing said filament.

10 Claims, 1 Drawing Sheet

PROCESS FOR MAKING A BONDED SEWING THREAD WITH AQUEOUS BASED BONDING AGENTS VIA FOAM DELIVERY SYSTEM

FIELD OF THE INVENTION

The present invention relates to a process for bonding filament with aqueous based polyethylene terephthalate or polyurethane bonding agents via a foam delivery system.

BACKGROUND OF THE INVENTION

Historically, approaches for treating filament such as sewing thread have focused on applying a compound on the surface of the filament. This has usually been achieved by applying an organic solvent solution of the compound to the filament followed by solvent evaporation. Recently, radiation has been used to activate the primed surface of the filament. However due to pressing environmental concerns and economic feasibility, it is desirable to replace those systems with an aqueous based system.

U.S. Pat. No. 5,230,922 discloses a process for the bonding of lightweight fleeces. The process involves wetting a fleece with cold water, subjecting the fleece to suction extraction to remove excess water, impregnating the wetted fleece with a liquid bonding agent, heating the fleece impregnated with the bonding agent, and winding it up. U.S. Pat. No. 5,230,922 discloses that the amount of binder applied is highly dependent on the desired end product. It neither teaches a range for the amount of bonding agent to apply nor does it suggest the use of polyurethane or polyethylene terephthalate aqueous based bonding agents. Additionally, it is directed toward lightweight fleeces, not filaments.

U.S. Pat. No. 4,847,116 discloses a method of manufacturing a composite wet press felt fabric in which a homogeneous foam of polymeric resin particles, binder material, and a solvent is deposited on the surface of the fabric. The foam is distributed on the surface of the fabric in a uniformly thick layer. Heat treatment is applied to the base fabric to evaporate the solvent in the foam, to fuse the polymeric resin particles to each other and to the base fabric, and to cure the binder material. Representative polymeric resins are polyolefins such as polyethylenes and polyurethanes. The binders can be high temperature resistant resins which are applied as liquids and which cure to a solid film under heat.

German Patent DE 4327783A1 relates to a bonded sewing thread in which bonding is achieved by impregnating the outer surface of the thread with at least one precursor material which can be activated before the thread is used. After activation, the precursor is chemically changed into a product which increases the bonding of the thread.

U.S. Pat. No. 4,141,315 relates to an apparatus for applying a thin layer of liquid systems to fibers, threads, or sheets which are moved uniformly in a linear direction. Liquid systems may be lubricants, antistatic agents, emulsifiers, wetting agents, and bactericides. They may be applied uniformly, in controllable quantities, and in the form of a foam to fibers, threads, or sheets. The fibers, threads, or sheets to be coated may be of polyamides, polyesters, polyacrilonitriles, polyolefins, carbon, glass, asbestos, or aluminum oxide. However, the process is particularly suitable for threads and fibers of polyamide-6. No reference is made to the aqueous based bonding agents of the present invention.

U.S. Pat. No. 2,533,167 relates to an apparatus and to a method of applying a liquid adhesive to a web of fibrous material. The method comprises supporting the web adjacent and above, but out of contact with, the exposed surface of a pool of liquid adhesive. Gas is forced under pressure upwardly from below the surface of the pool to form bubbles. The web is then passed through the bubbles causing them to burst and deposit their liquid adhesive on the web. The web of fibers is then heated and dried. Although U.S. Pat. No. 2,533,167 teaches the application of adhesives to fiber, it does not disclose the aqueous based bonding agents of the present invention.

"Coating Carbon Fibers with Thermoplastic Polymers Using Aqueous Foam" by R. R. Chary and D. E. Hirt discusses a process using aqueous foam as a carrier medium to deposit polymer on fiber tow such as carbon fibers. No reference is made to the aqueous based bonding agents of the present invention.

SUMMARY OF THE INVENTION

A process for bonding filament with aqueous based polyethylene terephthalate or polyurethane bonding agents via a foam delivery system is disclosed. The process includes the steps of: (a) providing the filament; (b) providing a foam prepared by foaming a solution comprising an agent selected from the group consisting of polyethylene terephthalate or polyurethane bonding agents; (c) applying the foam to said filament; and (d) drying and curing said filament.

DESCRIPTION OF THE INVENTION

Figure 1:
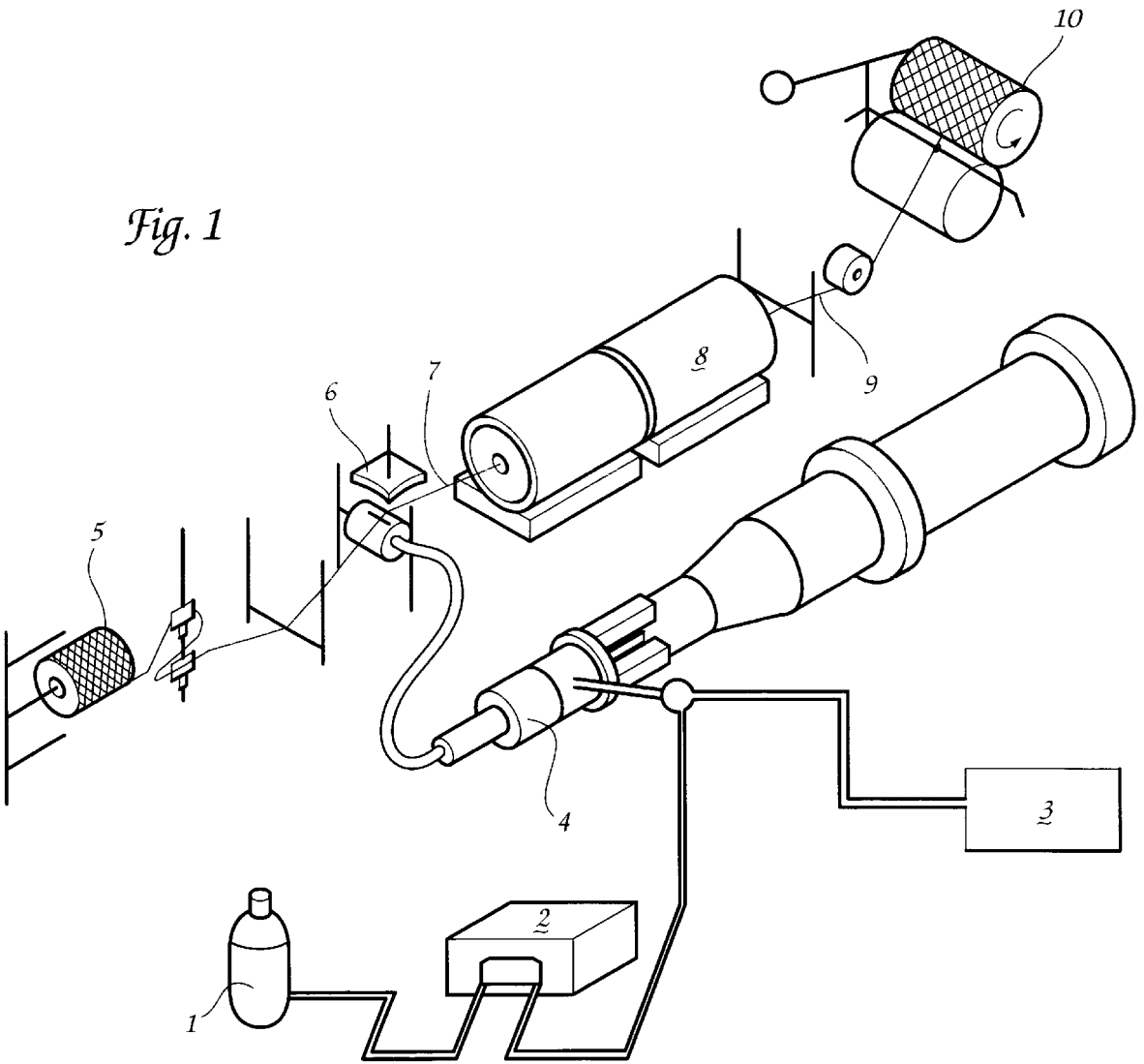
FIG. 1 depicts one mode by which the disclosed process can be implemented.

In accordance with the present invention, the process for bonding filament with aqueous based bonding agents via a foam delivery system entails providing a filament.

"Filament," as used herein, refers to a fiber of an indefinite or extreme length that either occurs naturally or as the result of extruding a synthetic, fiber-forming substance. Preferably, the filament is of a synthetic, fiber-forming substance such as polyester or polyamide. Polyester, for example, is produced commercially in a two step polymerization process. Either monomer formation by ester interchange of dimethyl terephthalate (DMT) with glycol or an uncatalyzed direct esterification of terephthalic acid with glycol, followed by polycondensation by removing excess glycol. Polyamide, for example, is a synthetic polymer produced from simple chemical compounds that are linked together by amide linkages (i.e., —NH—CO—). To form filaments of a synthetic, fiber-forming substance, a synthetic polymer is melted and forced through the holes of a spinneret. The solidified filaments are then drawn and collected by means, including but not limited to, rotating rolls that wind the filaments onto bobbins or pirns.

Once filament has been obtained, an aqueous solution is prepared based upon the preferred weight percentages of surfactant and of bonding agent. (The surfactant, if present, is preferably ionic, more preferably sodium dodecyl sulfate.) The surfactant is preferred to have a concentration from about zero weight percent to about two weight percent of the solution.

"Bonding agent," as used herein, refers to an aqueous based, resin coating composition that physically coats and externally changes the filament without the assistance of an organic solvent. The bonding agents are selected from the group consisting of polyurethane and polyethylene terephthalate bonding agents. The concentration of the bonding agent is from about 15 weight percent to about 50 weight percent of solids. It is an object of the present invention to use combinations of different polyethylene terephthalate bonding agents, polyurethane bonding agents, or mixtures of polyethylene terephthalate and polyurethane bonding agents. An example is a combination of polyurethane bonding agents in a ratio of 2:1.

It is an object of the present invention that the solution of bonding agent, water, and surfactant be foamed. The solution serves as the liquid feed stream to the foam generator. It is met by an external gas stream as it is blown into the foam generator. The foam generator can operates at room temperature. Preferably, the gas used in the present invention is air.

The term "blow ratio," as used herein, refers to the volumetric ratio of the gas flow rate to the liquid flow rate. In particular, liquid flow refers to the liquid feed stream comprised of water, surfactant, and bonding agent. Gas flow refers to the air stream that is blown into the foam generator. Preferrably, the blow ratio ranges from about 5:1 to about 30:1. The more preferred blow ratio for the process of the present invention is 10:1. "Foam," as used herein, refers to the result of the dispersion of gas in the liquid and is a function of the liquid and gas flow rates.

The foam, once generated, is characterized by its foam quality and foam stability. "Foam quality," as used herein, refers to the volume fraction of gas in a foam. Foam quality can be calculated after measuring the mass of a given volume of foam. "Foam stability," as used herein, refers to the approximate time required for a column of foam (e.g., contained in a 100 ml graduated cylinder) to decay to half its initial height at a given test temperature (i.e., the time required for the foam to decay from the 100 ml mark to the 50 ml mark). This is a crude version of what is called the Ross-Miles foam test. It is crude because the liquid drains to and collects at the bottom of the cylinder, which is somewhat less efficient than the Ross-Miles test.

Another step in the process of the present invention is applying the foam to the filament. The foam may be applied to the filament by a variety of application methods, including but not limited to, a padder, doctor blades, rotary screens, two-sided applicators, a vacuum, metering systems, and slot jets.

After the foam is applied to the filament, the filament is dried and cured in a heating medium. The heating medium includes, but is not limited to, conventional drying techniques such as ovens and tube furnaces. Preferably, the drying temperature is about 200° C. to about 300° C. Preferably, the residence time of the drying and curing step is about one to about eight seconds. After the filament is dried and cured, it is wound and stored in such a manner as to facilitate handling and storage.

This invention will now be described in greater detail by way of the following non-limiting example.

EXAMPLE

In Tables I–VII, the bonding agents referred to as PU "A", "B", and "C" are commercially available from Soluol Chemical Co. as SOLUCOTE 1013, 1016, and 1017, respectively. The bonding agent referred to as PU "D" is commercially available from Stahl USA as UE-41500. The bonding agent referred to as PET "A" is commercially available from Amoco Chemical Co. as SG-375.

An aqueous solution was prepared comprising a polyethylene terephthalate or polyurethane bonding agent. The amounts of water, bonding agent, and surfactant that were combined to form the solution depended upon the desired weight percentages of surfactant and of bonding agent. Typically, if a surfactant was used, it was first dissolved in water and then the bonding agent was dispersed into the surfactant-water solution. In Table I for example, a 17% solids concentration of bonding agent polyurethane "A" was dispersed into a solution of 1% surfactant and water. Special attention was paid when calculating the amount of surfactant and bonding agent that was to be added because the bonding agent was obtained as an aqueous mixture from the manufacturers.

In the above mentioned run of Table I for example, the bonding solution was circulated by a pump (2). It served as the liquid feed (1) to the foam generator (4). An external air stream (3) was blown into the foam generator (4) at a volumetric ratio of gas flow rate to liquid flow rate (i.e., blow ratio) of 5.3:1. The foam generator (4), operating at room temperature and a designated rpm, produced the foam that was applied to the polyester filament. The foam stability at room temperature and the foam quality for this particular run were measured and recorded in Table I.

Next, the foam was applied to the polyester filament (5) via a slot applicator with pressure pad (6). In Run 1 of Table VI, for example, the polyester filament (5) was threaded through a slot applicator (6) at about 36 feet per minute and coated with foam containing a polyurethane bonding agent. The coated filament (7) proceeded into tube furnaces (8) (Barnstead/Thermolyne, Model F21125) where it was dried at 160° C. and cured for about four seconds. The exiting bonded filament (9) was then wound on a roll (10) for ease of handling.

Physical property data for the bonded polyester filament, specifically stiffness and bond strength, was recorded in Table VII. Stiffness and bond strength were measured by the following test methods, procedures which are well known in the art. For the stiffness test, set up conditions on the standard equipment to pull on the material, includes a cross head speed of one inch per minute and a gauge length set to where the hole in the upper pole rod is approximately ⅛" below the hole in the lower coupling. The procedure for the stiffness test is to cut thread into two three inch pieces. A cut piece of thread is inserted into the hole in the upper pole rod so that the thread is centered and balanced. The Instron® is activated to pull the thread sample through the hole in the lower coupling. This procedure is repeated until five pieces of thread have been tested. The report is the average force in grams of the five tests. As to the bond strength, for the bond strength test, set up conditions that includes a cross head speed of three inches per minute and a gauge length of ¼". For the procedure, the thread is cut into two inch pieces. The four ply bonded thread is separated into two and two for the first inch of the two inch sample. Two of the plys are inserted in the top jaws, and the other two plys are inserted into the bottom jaws. The Instron is activated to pull the two plys apart. This procedure is repeated until three pieces of thread have been tested. The average is reported in grams required to separate the two plys.

Additionally, Tables I through VII present the results of bonding runs conducted via the above mentioned procedure, with slight variations in experimental conditions and foam compositions. Polyurethane bonding agents "A" through "D" represent varying degrees of stiffness.

TABLE I

Foaming Solution of Polyurethane "A"

| Solids Conc (%) | Surfactant Conc (%) | Blow Ratio | Foam Quality | Test Temp (° C.) | Foam Stability (min:sec) |
|---|---|---|---|---|---|
| 17 | 1 | 5.3:1 | 0.84 | Room T | 12:23 |
| 17 | 1 | 9.1:1 | 0.90 | Room T | 12:58 |
| 17 | 2 | 8.8:1 | 0.90 | Room T | 17:42 |
| 17 | 2 | 15.4:1 | 0.94 | Room T | 16:14 |
| 17 | 1 | 8.1:1 | 0.89 | Room T | 1:54 |
| 17 | 2 | 4.9:1 | 0.83 | Room T | 2:19 |
| 17 | 2 | 11.5:1 | 0.92 | Room T | 1:57 |

TABLE II

Foaming Solution of Polyurethane "B"

| Solids Conc (%) | Surfactant Conc (%) | Blow Ratio | Foam Quality | Test Temp (° C.) | Foam Stability (min:sec) |
|---|---|---|---|---|---|
| 17 | 2 | 5.3:1 | 0.84 | Room T | 11:55 |
| 17 | 2 | 7.5:1 | 0.88 | Room T | 13:41 |
| 17 | 2 | 5.5:1 | 0.85 | 200 | 2:59 |
| 17 | 2 | 4.6:1 | 0.82 | 260 | 2:19 |

TABLE III

Foaming Solution of Polyurethane "C"

| Solids Conc (%) | Surfactant Conc (%) | Blow Ratio | Foam Quality | Test Temp (° C.) | Foam Stability (min:sec) |
|---|---|---|---|---|---|
| 17 | 2 | 5.6:1 | 0.85 | Room T | 10:49 |
| 17 | 2 | 4.6:1 | 0.82 | 200 | 2:39 |
| 17 | 2 | 6.9:1 | 0.87 | 260 | 1:56 |

TABLE IV

Foaming Solution of Polyurethane "D"

| Solids Conc (%) | Surfactant Conc (%) | Blow Ratio | Foam Quality | Test Temp (° C.) | Foam Stability (min:sec) |
|---|---|---|---|---|---|
| 17 | 0 | 5.0:1 | 0.83 | Room T | 2:32 |
| 17 | 1 | 10.4:1 | 0.91 | Room T | 8:43 |
| 17 | 1 | 26.8:1 | 0.96 | Room T | 8:00 |
| 17 | 2 | 10.5:1 | 0.91 | Room T | 13:10 |
| 17 | 2 | 24.6:1 | 0.96 | Room T | 11:44 |
| 17 | 0 | 4.5:1 | 0.82 | 260 | 1:00 |
| 17 | 1 | 14.6:1 | 0.94 | 260 | 1:30 |
| 17 | 2 | 20.7:1 | 0.95 | 260 | 1:35 |

TABLE V

Foaming Solution of Polyethylene Terephthalate "A"

| Solids Conc (%) | Surfactant Conc (%) | Blow Ratio | Test Temp (° C.) | Foam Stability (min) |
|---|---|---|---|---|
| 17 | 0 | 9.6:1 | Room T | 1.0 |
| 17 | 1 | 26.5:1 | Room T | 16.0 |
| 25.3 | 0.1 | 5.2:1 | Room T | 4.5 |
| 17 | 0 | 10.0:1 | 200 | 0.7 |

TABLE V-continued

Foaming Solution of Polyethylene Terephthalate "A"

| Solids Conc (%) | Surfactant Conc (%) | Blow Ratio | Test Temp (° C.) | Foam Stability (min) |
|---|---|---|---|---|
| 17 | 1 | 9.1:1 | 200 | 3.6 |
| 25.3 | 1 | 9.7:1 | 200 | 2.9 |

TABLE VI

Applying Foam to Filament

| Run # | Bond Agent | Solids Conc (%) | Surf Conc (%) | Blow Ratio | Winder Speed (ft/min) | Oven Temp (° C.) | Resid Time (sec) | % Solids De-posited (Dry) |
|---|---|---|---|---|---|---|---|---|
| 1 | PU"A" | 17 | 1 | 10:1 | 36 | 160 | 4 | 6.2 |
| 8 | PU"C" | 17 | 2 | 5:1 | 38 | 280 | 4 | 7.7 |
| 11 | PET"A" | 25.3 | 0.1 | 20:1 | 38 | 275 | 4 | 8.9 |
| 15 | PU"D" | 17 | 1 | 9:1 | 38 | 285 | 4 | 4.3 |
| 21 | PU"C"/ PU"D" (2:1) | 17 | 2 | 5:1 | 38 | 285 | 4 | 6.7 |

TABLE VII

Physical Property Data of Treated Filament

| Run # | Bond Agent | Sol-ids Conc (%) | Surf Conc (%) | Blow Ratio | Oven Temp (° C.) | Resid Time (sec) | Stiff-ness (grams) | Bond Strength (grams) |
|---|---|---|---|---|---|---|---|---|
| PET[1] | — | — | 0 | 0 | 218 | 4 | 9.0 | 10.6 |
| Nylon[2] | — | — | 0 | 0 | 218 | 4 | 6.3 | 7.9 |
| 1 | PU"A" | 17 | 1 | 10:1 | 160 | 4 | 15.0 | 8.1 |
| 8 | PU"C" | 17 | 2 | 5:1 | 280 | 4 | 7.9 | 7.3 |
| 11 | PET"A" | 25.3 | 0.1 | 20:1 | 275 | 4 | 24.0 | 9.8 |
| 15 | PU"D" | 17 | 1 | 9:1 | 285 | 4 | 11.5 | 8.4 |
| 21 | PU"C"/ PU"A" (2:1) | 17 | 2 | 5:1 | 285 | 4 | 10.4 | 6.8 |

NOTES:
[1]Commercially available Anefil Polyester, size 92.
[2]Commercially available Anefil Nylon, size 92.

The present invention may be embodied in other specific forms without departing from the spirit or essential attributes thereof, and accordingly, reference should be made to the appended claims, rather than to the foregoing specification, as indicating the scope of the invention.

We claim:

1. A process for making a bonded sewing thread with aqueous-based bonding agents using a foam delivery system, said process comprising the steps of (a) providing a multi-ply filament structure;

(b) foaming a liquid stream comprising water and a bonding agent by use of a gas stream, said bonding agent being selected from the group consisting of at least one polyethylene terephthalate bonding agents, and a mixture of polyethylene terephthalate and polyurethane bonding agents, to provide an aqueous foam;

(c) thereafter applying said aqueous foam to said multi-ply filament structure; and (d) thereafter heat-treating the foam-coated, multi-ply filament structure at a temperature of 160 degrees C. or more, to make a bonded sewing thread comprising said multi-ply filament structure.

2. The process of claim 1, wherein said aqueous foam comprises from about 0 to 2 weight percent of a surfactant.

3. The process of claim 1, wherein said aqueous foam comprises a surfactant.

4. The process of claim 3, wherein said surfactant is sodium dodecyl sulfate.

5. The process of claim 1, wherein the foaming is at a given gas flow rate and liquid flow rate.

6. The process of claim 1, wherein the heat-treating is from about 200 degrees C. to about 300 degrees C.

7. The process of claim 1, wherein the residence time of the heat-treating step is from about 1 to about 8 seconds.

8. The process according to claim 3 wherein the concentration of said bonding agent is from about 15 weight percent to about 50 weight percent of solids.

9. The process according to claim 5 wherein the volumetric ratio of said gas flow rate to said liquid flow rate is from about 5:1 to about 30:1.

10. The process according to claim 9 wherein the ratio of said gas flow rate to said liquid flow rate is about 10:1.

* * * * *